US005404706A

United States Patent [19]

Ueno et al.

[11] Patent Number: 5,404,706

[45] Date of Patent: Apr. 11, 1995

[54] METHOD OF FALSE TWIST TEXTURING AND A FALSE TWIST TEXTURING MACHINE

[75] Inventors: Noboru Ueno; Takao Negishi, both of Otsu, Japan

[73] Assignee: Toray Industries, Inc., Japan

[21] Appl. No.: 288,966

[22] Filed: Aug. 10, 1994

Related U.S. Application Data

[63] Continuation of Ser. No. 689,931, Dec. 9, 1991, abandoned.

[30] Foreign Application Priority Data

Oct. 9, 1989 [WO] WIPO ..... PCT/JP89/01036

[51] Int. Cl.[6] ..... D01H 7/46; D01H 1/42

[52] U.S. Cl. ..... 57/290; 57/284; 57/336; 57/351

[58] Field of Search ..... 57/284, 290, 291, 336, 57/351

[56] References Cited

U.S. PATENT DOCUMENTS

| | | | |
|---|---|---|---|
| 4,138,840 | 2/1979 | Greenway et al. | 57/289 |
| 4,173,861 | 11/1979 | Norris et al. | 57/290 X |
| 4,398,386 | 8/1983 | Endo et al. | 57/290 X |

FOREIGN PATENT DOCUMENTS

| | | | |
|---|---|---|---|
| 38685 | 10/1981 | European Pat. Off. | 57/291 |
| 2380363 | 10/1978 | France | 57/281 |
| 2424344 | 12/1979 | France | 57/290 |
| 57-191342 | 11/1982 | Japan . | |
| 1-139838 | 6/1989 | Japan . | |
| 1248089 | 9/1971 | United Kingdom . | |

*Primary Examiner*—Daniel P. Stodola
*Assistant Examiner*—William Stryjewski
*Attorney, Agent, or Firm*—Austin R. Miller

[57] ABSTRACT

Method and apparatus for high speed false twist texturing of yarns, which makes it possible to perform false twist texturing smoothly at a yarn speed of 1,000 m/min or higher. The number of false-twists inserted per meter of yarn is determined by Equation 1, while the yarn is false-twisted at a yarn speed satisfying Equation 2 and at a short yarn path length satisfying Equation 3:

$$T \geqq 0.24/\sqrt{A} \qquad \text{Equation 1}$$

$$V \geqq 1.30 \times 10^{-3}/\sqrt{A} \qquad \text{Equation 2}$$

$$L \leqq 90/V, \qquad \text{Equation 3}$$

wherein T is the number of false-twists inserted per meter of yarn, V is the yarn speed of false twist texturing (m/sec), L is the yarn path length from teed rollers to a false twister (m), and A is a cross sectional area of the yarn ($m^2$), which is obtained by dividing the denier of the yarn by the density of the yarn. The false-twist texturing apparatus includes feed rollers feeding yarn to a false-twisting zone, a heating device bringing the yarn into direct contact with steam, a cooling device bringing the yarn into direct contact with water, a false twister and delivery rollers, in this order.

7 Claims, 1 Drawing Sheet

METHOD OF FALSE TWIST TEXTURING AND A FALSE TWIST TEXTURING MACHINE

This application is a continuation of application Ser. No. 07/689,931, filed Dec. 9, 1991, now abandoned.

TECHNOLOGICAL FIELD

The present invention relates to a method of high speed false twist texturing and a high speed false-twist texturing machine and furthermore in detail, the present invention relates to a method of high speed false twist texturing which makes it possible to perform smoothly the false twist texturing at a yarn speed of 1,000 m/min or higher and a high speed false-twist texturing machine for performing smoothly the method.

BACKGROUND TECHNOLOGY

Up to the present time, in the field of false twist texturing of thermoplastic multi-filament yarns, to improve productivity, developments of new manufacturing technologies as described below have been promoted in the concerned industrial field.

(1) To attempt to promote labor-saving by making packages of an original yarn for false twist texturing and a textured yarn thereof larger and promoting automation of handling of the package.

(2) To attempt to promote energy-saving by developing a heating method, a cooling method etc., with high efficiency.

(3) To attempt to promote space-saving by developing a simple and compact installation.

Furthermore, to achieve an ultrahigh processing at 1,000 m/min or higher has been recently tried. Means used to perform an ultrahigh false twist texturing up to the present time are as follows.

(1) A highly-oriented undrawn yarn (POY; Partially Oriented Yarns) is used as a fed original yarn.

(2) A heater is made longer in accordance with the heater processing speed. In this case, the heater means a so-called dry hot-plate generally heating a metal plate with a smooth surface with which a yarn is brought into contact by using a heating medium such as "Dowtherm".

(3) A yarn-contacting plate made of a metal is used as a cooling device and in addition, a so-called cooling plate positively cooling said yarn-contacting plate with chilled water is used.

(4) A friction-type one capable of twisting with high speed is used as the false twister.

(5) To suppress ballooning of a yarn, a part where the yarn is freely running is made as low as possible.

(6) Polishing of yarn path parts such as guides where the yarns are brought into contact with is made better.

However, when a yarn speed reaches 1,000 m/min or larger using such means as these, the lengths of the dry hot-plate and the cooling plate which have been conventionally used are too short to make sufficient heating-cooling and the quality level of the conventional textured yarn can not be kept. In addition, if the dry hot-plate and the cooling plate are made longer to perform sufficient heating, ballooning is generated on a twisted yarn and if the length is furthermore made longer, it becomes impossible to set the yarn on the devices. In addition, if the yarn speed is increased, ballooning is generated on the twisted yarn, which becomes easily separated from the dry hot-plate and the cooling plate resulting in insufficient heating-cooling. If the texturing speed is increased, the generated ballooning increases yarn breakage, by which it becomes impossible to keep stable production. If the productivity is unstable, it is not possible to reduce cost based on speeding up the process.

Therefore, to keep processing stability at high speed, suppressing ballooning is tried by making the number of twists smaller than that for a texturing condition at low speed, or increasing processing tension, especially twisting tension. But in such a case, it is of course impossible to obtain good physical properties of a textured yarn.

Taking problems of high speed false twisting described above into consideration, the present inventors have extensively studied them and reached the present invention.

DISCLOSURE OF THE INVENTION

A purpose of the present invention is to offer a method of false twist texturing and a false-twist texturing machine wherein good textured yarn characteristics even when a high speed false twist exceeds 1,000 m/min and stable and high productivity can be kept.

To achieve the above described purpose, the present invention consists of the following:

The present invention relates to a method of false twist texturing characterized by such a false twist texturing that is performed at a high number of false twist satisfying the below described equation 1 to obtain a false twisted textured yarn of high quality, is false-twisted at a yarn speed satisfying the below described equation 2 to obtain high productivity and furthermore, is false-twisted at a short yarn path length satisfying the below described equation 3 to obtain high processing stability when a thermoplastic multi-filament yarn is false-twisted and a false-twist texturing machine to perform said method of false twist texturing.

$$T \geqq 0.24/\sqrt{A} \qquad \text{Equation 1}$$

$$V \geqq 1.30 \times 10^{-3}/\sqrt{A} \qquad \text{Equation 2}$$

$$L \leqq 90/V \qquad \text{Equation 3}$$

wherein T is the number of false twists inserted per meter of the yarn (n times/m; n is the number of turn of the twist);

V is the yarn speed of false twist texturing (m/sec);

L is a yarn path length from rollers feeding a yarn in the false-twisting zone to a false twister inserting false twists (m);

A is a cross-sectional area of the yarn ($m^2$); which is obtained by dividing a denier of the yarn (a weight per unit length) by a density of the yarn (a weight per unit volume).

In addition, a false-twist texturing machine of the present invention is a false-twist texturing machine characterized by that a false-twist texturing machine performing a false twist texturing of a thermoplastic multi-filament yarn consists of an apparatus arranging at least feed rollers feeding a yarn in a false-twisting zone, a heating device bringing the yarn into direct contact with steam, a cooling device bringing the yarn into direct contact with water, a false twister and delivery rollers in that order.

Best Embodiments Practicing the Present Invention

Figure 1:
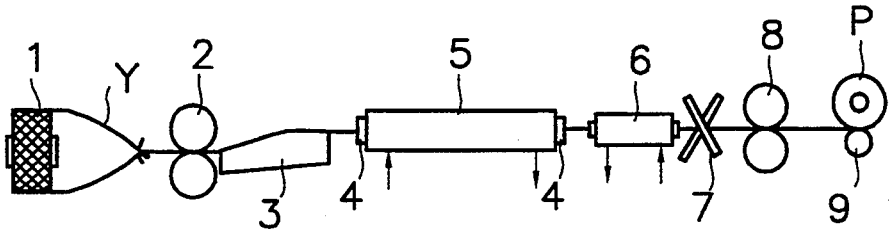
FIG. 1 is a rough drawing illustrating an example of a drawing and false-twisting machine of the present invention and FIG. 2 is a rough drawing illustrating a drawing and false-twisting machine of the comparative example.

The present invention will be explained in more detail in the following.

At first, the present invention is to offer a method of false twist texturing wherein when a thermoplastic multi-filament yarn is false-twisted, to obtain a false-twist textured yarn of high quality, the number of false twist is restricted at a value of $0.24/\sqrt{A}$ or larger.

Namely, even at a yarn speed of 1,000 m/min or higher, to keep the same physical properties of a false-twist textured yarn as those of the false-twist textured yarn obtained at a yarn speed of lower than 1,000 m/min, the number of false twist T is restricted at a value of $0.24/\sqrt{A}$ or larger. It is restricted preferably at a value of $0.25/\sqrt{A}$ or larger, more preferably at a value of $0.26/\sqrt{A}$ or larger.

In addition, in the present invention, said value of A can be obtained by calculation from the weight per unit length of the obtained yarn and the specific gravity of said yarn.

In addition, the number of false twist T is a value obtained by sampling carefully a false-twisted yarn from the texturing machine while the yarn is textured and measuring it.

Secondly, the present invention offers a method of false twist texturing wherein when a thermoplastic multi-filament yarn is false-twisted, to obtain a false-twist textured yarn of high quality and high productivity, the yarn speed V is restricted at a value of $1.30\times10^{-3}/\sqrt{A}$ or larger.

Namely, to keep both high productivity and the same good physical properties of a textured yarn as those of a textured yarn manufactured by the conventional low speed texturing, the yarn speed V is restricted at $1.30\times10^{-3}/\sqrt{A}$ or larger. It is preferably at $1.55\times10^{-3}/\sqrt{A}$ or larger, more preferably at $1.81\times10^{-3}/\sqrt{A}$ or larger.

Thirdly, the present invention offers a method of false twist texturing wherein when a thermoplastic multi-filament yarn is false-twisted, to obtain a high texturing stability, the yarn path length L from feed rollers feeding a yarn in the false-twisting zone to a false twister inserting false twist is restricted at a value of 90/V or larger.

Namely, up to the present time, to increase a yarn speed of false twist texturing, one deals with extension of the lengths of a dry hot-plate and a cooling plate used.

As the result, in the commercially available false-twist texturing machine, such a machine that has a total length of the dry hot-plate and the cooling plate cf 5 m or longer at the maximum machine speed of 1,200 m/min appears in the marketplace.

In the present invention, to obtain a high texturing stability, a high productivity and good physical properties of a textured yarn by performing false twist texturing of a thermoplastic multi-filament yarn, it is confirmed that when the yarn path length from feed rollers feeding a yarn in the false-twisting zone to a false twister inserting false twist is restricted, a stable false twist texturing with a lower tension in comparison with the conventional method, without occurrence of ballooning in the twisted yarn and without yarn breakage can be realized. In this case, the yarn path length L from feed rollers feeding a yarn in the false-twisting zone to a false twister inserting false twist is a value of 90/V or shorter and preferably, a value of 70/V or shorter and more preferably, a value of 50/V or shorter.

As described above, in the present invention, by restricting relations with the number of false twist per meter of a yarn, the yarn speed of false twist texturing, the yarn path length from feed rollers feeding a yarn in the false-twisting zone to a false twister inserting false twist and the actual cross-sectional area of a yarn, it is possible to obtain stable productivity and good physical properties of a textured yarn even when the false twist texturing is performed at high speed.

Next, in the present invention, it is preferable that heat treatment of a textured yarn is performed in an atmosphere of a high temperature fluid.

Namely, if the yarn path length from feed rollers feeding a yarn in the false-twisting zone to a false twister inserting false twist is restricted in relation with the yarn speed of false twist texturing, it is not entirely possible to obtain good physical properties of a textured yarn without utilizing a heating method which is performed in an atmosphere of a high temperature heating fluid and is accordingly a short time and high efficient heating method in comparison with the conventional dry hot-plate.

The high temperature fluid used in the false twist texturing of the present is not specially restricted, but it is especially preferable to use a saturated steam.

In addition to the method heating in the atmosphere of this high temperature heating fluid, it is also possible to use a method heating by means of infrared heating and dielectric heating in parallel with this method. In addition, the method heating in the atmosphere of this high temperature heating fluid can be used in parallel with other heating methods.

Furthermore, in the present invention, it is preferable that cooling of the false-twisted yarn is performed in an atmosphere of a cooling fluid.

Namely, if the yarn path length from feed rollers feeding a yarn-in the false-twisting zone to a false twister inserting false twist is restricted in a relation with the yarn speed of false twist texturing, it is not entirely possible to obtain good physical properties of a textured yarn without utilizing a cooling method which is performed in an atmosphere of a cooling fluid and is accordingly a short time and highly efficient cooling method in comparison with the conventional cooling plate.

The cooling fluid used in the false twist texturing of the present invention is not specially restricted, but it is especially preferable to use water at room temperature.

The present invention is effective at a yarn speed of 1,000 m/min or larger, preferably effective at a yarn speed of 1,200 m/min or larger and more preferably effective at a yarn speed of 1,400 m/min or larger.

As a thermoplastic multi-filament yarn used for false twist texturing of the present invention, no specific restriction exists and any yarn that can be false-twist textured is applicable. Especially, polyester fibers and polyamide fibers are suitably applicable.

In addition, in the present invention, false twist texturing includes not only a case wherein a drawn yarn and a yarn spun at about 5,000 m/min or higher (OSP yarns; One-Step Process yarns based on high-speed spinning) is false-twist textured, but also a case wherein an undrawn yarn and a highly oriented undrawn yarn (POY) is drawn and false-twisted.

Next, a false-twist texturing machine of the present invention will be described.

In the present invention, it is essential that the false-twist texturing machine performing false twist texturing of a thermoplastic multi-filament yarns is restricted to such a false-twist texturing machine that contains an apparatus arranging at least feed rollers feeding a yarn in a false-twisting zone, a heating device bringing the yarn into direct contact with steam, a cooling device bringing the yarn into direct contact with water, a false twister and delivery rollers in this order.

Namely, the present invention offers a false-twist texturing machine operated at high speed, with excellent texturing stability and providing a textured yarn of good quality by arranging at least feed rollers feeding a yarn in a false-twisting zone, a heating device bringing the yarn into direct contact with steam, a cooling device bringing the yarn into direct contact with water, a false twister and delivery rollers in this order in the false-twist texturing machine performing false twist of a thermoplastic multi-filament yarn.

Namely, in the present invention, to obtain stable productivity and good physical properties of a textured yarn when a thermoplastic multi-filament yarn is false-twist textured, using a heating device bringing the yarn with a fast heat-transmitting speed into direct contact with steam and a cooling device bringing the yarn with a fast cooling speed into direct contact with water, making a free zone from feed rollers feeding the yarn in a false-twisting zone to a twister inserting false twist as few as possible and shortening the length of the yarn path from feed rollers feeding the yarn in the false-twisting zone to the twister inserting false twist as short as possible are tried. A false-twist texturing machine which can realize a stable false twist texturing with a low tension in comparison with the conventional one, without occurrence of ballooning in the twisted part and without yarn breakage is confirmed. In addition, physical properties of the obtained textured yarn are excellent.

The present invention offers a false-twist texturing machine with high speed, stable productivity and good physical properties of a textured yarn by restricting a heating device bringing a yarn into direct contact with steam to a heating device with a yarn path sealing part which substantially prevents leaking of hardly leaks steam out of the device.

Namely, the pressure of steam used in the heating device in the false-twist texturing machine of the present invention, is ordinarily higher than the atmospheric pressure. The heating device consists of a heating cylinder furnished with a seal mechanism at an inlet and an outlet hole of a yarn to be heated in such a way that steam with a pressure higher than the atmospheric pressure does not leak from a heating device. If said seal mechanism does not exist, steam leaks approximately along the yarn pass and disturbs the yarn in the false-twisting zone and as the result, it is impossible to perform stable false twist texturing. In addition, if said seal mechanism does not exist, a remarkably large amount of steam flows out of the heating device fed with steam and uniform and stable heating is not performed and good physical properties of a textured yarn are not obtained.

The present invention offers a false-twist texturing machine providing high speed and stable productivity and good physical properties of a textured yarn by restricting a cooling device bringing a yarn into direct contact with water in the false-twist texturing machine to a cooling device with a sealing part which substantially prevents leaking of water out of the device.

Namely, a cooling device consisting of a water bath with a seal mechanism at an inlet and an outlet of a yarn to be cooled in such a way that water etc., hardly leaks from the cooling device. If said seal mechanism does not exist, water is taken out of the cooling device by running of the yarn in a false-twisting zone and a lubricant, a polymer or an oligomer produced by decomposition of said polymer released from the yarn accompanied with water are scattered by rotation of the yarn in the false-twisting zone out of said cooling device. Some of these scattered substances adhere or accumulate on the yarn path part. As the yarn is brought into contact with this accumulation on the yarn path part, producing yarn breakage, it is impossible to perform a false twist texturing with high speed and stability.

It is essential in the present invention that the yarn path length from feed rollers feeding a yarn in a false-twisting zone to a twister inserting false twist is restricted at 90/V or shorter in the false-twist texturing machine.

Namely, by speeding up of the yarn speed in the false twist texturing, lengths of a heating device and a cooling device placed between feed rollers feeding a yarn to a false-twisting zone and a twister inserting false twist are each extended and the yarn path length from said feed rollers to said false-twister is also extended as a whole. Caused by long yarn path, movements of rotation and running of the yarn in the false-twisting zone becomes unstable and as the result, said yarn produces ballooning, and stable texturing is impossible. Therefore, the length of said yarn path is restricted at 90/V or shorter to perform stable movements of rotation and running of the yarn in the false-twisting zone.

In the present invention, it is effective that a normal operation can be performed at a yarn speed on delivery rollers of 1,000 m/min or larger in the false-twist texturing machine. Preferably, said yarn speed is effective at 1,200 m/min or larger and more preferably, effectiveness is more exhibited at said yarn speed of 1,400 m/min or larger.

The false-twister of the false-twist texturing machine of the present invention is not specially restricted, but a triaxial circumscribed frictional twister and a belt type frictional twister are preferably used.

Practical examples will be described hereinbelow, but the present invention is not restricted at all thereby.

Figure 2:
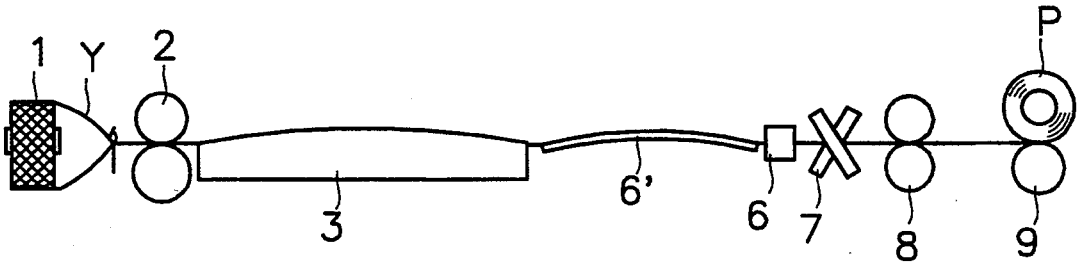
Fig. 2 PRIOR ART

FIG. 1 is a rough drawing illustrating an example of a drawing and false-twisting machine of the present invention and FIG. 2 is a rough drawing illustrating a drawing and false-twisting machine of the comparative example. In these figures, 1 is a package; 2 are feed rollers; 3 is a dry hot-plate; 4 is a seal mechanism; 5 is a heat-treating device with a high temperature fluid; 6 is a cooling device with a cooling fluid; 6' is a cooling plate; 7 is a belt type frictional twister; 8 are delivery rollers; 9 is a driving roller for winding; Y is a highly oriented undrawn yarn; P is a textured yarn. Below described Example and Comparative. Examples are performed by means of the apparatus outlines of which are illustrated in these figures.

Example 1

Using a polyester multi-filament yarn with a birefringence Δn of 0.037, an elongation of 180%, a round crosssection, 139 denier and 36 filaments, an ultrahigh speed false-twist texturing with a speed of 2,000 m/min was performed by means of the drawing and false-twisting machine illustrated in FIG. 1.

In addition, in said machine, saturated steam was used as a high temperature fluid for the heat-treating device and water was used as a cooling fluid for the cooling device.

Conditions:

Yarn speed on delivery rollers=2,000 m/min
Surface speed on the twister belt=3,000 m/min
Speed of the feed rollers=1,064 m/min
Temperature of the dry hot-plate=220° C.
Length of the dry hot-plate=0.5 m
Temperature in the steam heat-treating device=213° C. (Pressure of saturated steam=20 kgf/cm$^2$G)
Length of the steam heat-treating device=1 m
Temperature of water in the cooling device=28° C.
Draw ratio=1.88
Twisting tension just before the twister=44 g
Number of false twist per unit length just before the twister=3,300 times/m
Length of the yarn path between the feed rollers in the false-twisting zone and the false-twister=2 m Comparative Examples 1 and 2

By means of the drawing and false-twisting machine based on the conventional technology and illustrated in FIG. 2, a false-twist texturing was performed under the same conditions as said Example except L=5 m (in Comparative Example 1) and V=10 m/sec (in Comparative Example 2).

Various physical properties of the false-twist textured yarns obtained by Example 1 and Comparative Examples 1 and 2 of the present invention were shown in Table 1.

Crimp recovery ratio among the properties shown in the table was obtained on the samples pretreated under the following condition based on the test method JIS L1090.

(1) An initial load of 2 mg/denier per an indicated denier was applied on a small hank.
(2) The hank on which the initial load was hanged was then immersed in hot water at 98±1° C. for 20 min.
(3) The immersed hank was taken out of hot water and the initial load was removed. The hank was left standing for about 12 hrs or longer under an ordered standing condition so as not to put the hank into disorder to bring it to a water equilibrium condition.
(4) The length l when the initial load of 2 mg/denier per denier was applied on this yarn and the length $l_1$ when a load of 0.1 g per denier was additionally applied on this initial load were measured and the crimp recovery ratio was obtained by the following equation.

$$\text{Crimp recovery ratio (\%)} = \frac{l - l_1}{l}$$

In addition, crimp generating stress (g) was measured under the following conditions by means of a crimp tester manufactured by Rothshild Co., Ltd.

Yarn speed: 16 m/min
Initial tension: 0.1 g/denier
Overfeed ratio: 4%
Heater temperature: 150° C.

As clearly shown in Table 1, a false-twist textured yarn obtained by Example 1 exhibited both strength, elongation, crimp recovery ratio and crimp generating stress superior to those for a false-twist textured yarn obtained by Comparative Example 1 and the same yarn physical properties as those of Comparative Example 2 which was the conventional low speed condition.

In addition, in Example 1, no yarn breakage and fluff were generated and the operation was stabilized.

Many fluffs were produced in the false-twist textured yarn in Comparative Example 1 and yarn breakage occurred very frequently and as the result, it was impossible to perform stable texturing.

On the other hand, in Comparative Example 2, good yarn physical properties were obtained and the operation was stable, but the productivity was remarkably low and it was impossible to obtain high productivity based on high speed false twisting which was the purpose of the present invention. [Industrial Application Fields]

By means of the method of false twist texturing and the false-twist texturing machine of the present invention as described above, a high speed false twist texturing with a yarn speed of 1,000 m/min or higher is practicable at a low tension in comparison with the conventional technology and smoothly and it is possible to obtain a textured yarn with good physical properties under such conditions that no yarn breakage and fluff generation occur and the operation is stable.

TABLE 1

| | Example 1 | Comparative Example 1 | Comparative Example 2 |
|---|---|---|---|
| L (m) | 2.0 | 5.0 | 5.0 |
| v (m/sec) | 33.3 | 33.3 | 10.0 |
| T (n times/m) | 3300 | 3300 | 3300 |
| A (m$^2$) | $6.0 \times 10^{-9}$ | $6.0 \times 10^{-9}$ | $6.0 \times 10^{-9}$ |
| Tensile Strength (g/d) | 5.0 | 4.2 | 5.0 |
| Elongation (%) | 17.8 | 14.1 | 20.1 |
| Crimp Recovery Ratio (%) | 31.0 | 16.0 | 31.5 |
| Crimp Generating Stress (g) | 1.95 | 1.35 | 1.90 |

We claim:

1. In a method of false twist texturing a yarn in a false-twisting device comprising a false twister for a false twisting of a yarn, feed rollers arranged for feeding said yarn to said false twister, and delivery rollers arranged for receiving said yarn from said false twister, the method comprising the steps of:

drawing a yarn into said false-twisting device at a yam speed of 1,000 meters per minute or higher;

inserting a number of false twists per meter of the yarn, T, into said yarn in accordance with the equation $T \geqq 0.24/\sqrt{A}$;

maintaining said false twister at a false twisting speed, V (m/sec), in accordance with the equation $V \geqq 1.30 \times 10^{-3}/\sqrt{A}$;

limiting the yarn path length from said feed rollers to said false twister, L (m), in accordance with the equation $L \leqq 90/V$;

wherein A is the cross-sectional area of the false-twisted yarn obtained by dividing the weight per unit length of the yarn by the weight per unit volume of the fiber of the yarn according to the equation $A=D/9{,}000/(P\times 10^6)$, wherein D is the yarn denier and P is the density of the fiber of the yarn ($g/cm^3$).

2. The method of false-twist texturing described in claim 1, wherein the yarn speed is more than 1200 m/min.

3. The method of false-twist texturing described in claim 1, wherein the yarn speed is more than 1400 m/min.

4. The method defined in claim 1, wherein the yarn is heated by steam.

5. The method defined in claim 1, wherein the yarn is heated by direct contact with steams and subsequently cooled by direct contact with water.

6. The method of false twist texturing described in claim 1, wherein the yarn while it is twisted is heated by a fluid, said fluid having a temperature substantially greater than atmospheric temperature.

7. A method of false twist texturing a yarn comprising:

drawing a yarn into a false-twister at a yarn speed of 1,000 meters per minute or more;

inserting a number of false twists per meter of the yarn, T, into said yarn in accordance with the equation $T\geqq 0.24/\sqrt{A}$, wherein A is the cross-sectional area of the false-twisted yarn obtained by dividing the weight per unit length of the yarn by the weight per unit volume of fibers of the yarn according to the equation $A=D/9{,}000/(P\times 10^6)$, D is the yarn denier and P is the density of fibers of the yarn ($g/cm^3$);

maintaining said false twister at a false twisting speed, V (m/sec), in accordance with the equation $V\geqq 1.30\times 10^{-3}/\sqrt{A}$; and limiting the yarn path length from feed rollers feeding said yarn to said false twister, L (m), in accordance with the equation $L\leqq 90/V$.

* * * * *

UNITED STATES PATENT AND TRADEMARK OFFICE

CERTIFICATE OF CORRECTION

PATENT NO. : 5,404,706

DATED : April 11, 1995

INVENTOR(S) : Noboru Ueno and Takao Negishi

It is certified that error appears in the above-indentified patent and that said Letters Patent is hereby corrected as shown below:

On the title page, at [54], please change "METHOD OF FALSE TWIST TEXTURING AND A FALSE TWIST TEXTURING MACHINE" to --HIGH SPEED FALSE TWISTING METHOD AND MACHINE THEREFOR--.

On the title page, at [57], line 17, please change "teed" to --feed--.

In Column 4, line 45, please change "yarn-in" to --yarn in--.

In Column 5, line 50, please delete "hardly leaks".

In Column 7, line 6, please change "2.000" to --2,000--.

In Column 8, line 59, please change "yam" to --yarn--.

Signed and Sealed this

Fourth Day of July, 1995

Bruce Lehman

*Attest:*

BRUCE LEHMAN

*Attesting Officer*

*Commissioner of Patents and Trademarks*